US005732893A

United States Patent [19]

Nied

[11] Patent Number: 5,732,893

[45] Date of Patent: Mar. 31, 1998

[54] DEVICE FOR FLUIDIZED-BED JET MILLING

[76] Inventor: Roland Nied, Raiffeisen Strasse 10, 86486 Bonstetten, Germany

[21] Appl. No.: 619,197

[22] Filed: Mar. 21, 1996

[30] Foreign Application Priority Data

Apr. 6, 1995 [DE] Germany ..... 195 13 034.0

[51] Int. Cl.[6] ..... B02C 19/06

[52] U.S. Cl. ..... 241/39; 241/5

[58] Field of Search ..... 241/5, 39, 40

[56] References Cited

U.S. PATENT DOCUMENTS

| | | | |
|---|---|---|---|
| 238,044 | 2/1881 | Luckenbach et al. | 241/39 X |
| 1,935,344 | 11/1933 | Andrews et al. | 241/39 |
| 2,821,346 | 1/1958 | Fisher | 241/39 |
| 3,424,386 | 1/1969 | Maasberg et al. | 241/39 X |
| 5,542,613 | 8/1996 | Nito . | |

FOREIGN PATENT DOCUMENTS

| | | |
|---|---|---|
| 598421 | 6/1934 | Germany . |
| 2040519 | 2/1972 | Germany . |
| 3338138 | 1/1986 | Germany . |
| 4243438 | 6/1994 | Germany . |

*Primary Examiner*—Mark Rosenbaum
*Attorney, Agent, or Firm*—Levine & Mandelbaum

[57] ABSTRACT

The present invention pertains to a fluidized-bed jet mill intended to overcome the problem whereby a fluid jet introduced into the fluidized bed at high velocity takes up solid particles from the fluidized bed mainly in the area of the jet near the circumference. To have solid particles in the core area of the fluid jet as well auxiliary jets with fluidized solid particles are caused to penetrate into the fluid jet to be introduced into the fluidized bed such that the solid particles reach the core area of the fluid jet to enrich the core area with solid particles and allow an area near the circumference to receive solid particles from the fluidized bed.

6 Claims, 1 Drawing Sheet

DEVICE FOR FLUIDIZED-BED JET MILLING

BACKGROUND OF THE INVENTION

The present invention pertains to fluidized-bed jet milling. A steam jet or preferably a gas jet is introduced at a high velocity into a fluidized bed of fluidized solid particles by means of a nozzle. Vacuum occurs in the jet, and solid particles are therefore drawn from the fluidized bed into the jet. The solid particles drawn in are accelerated in the jet to the high velocity of the gas jet. The impulse exchange between the solid particles, which is necessary for crushing, now tales place. The velocity distribution and consequently the vacuum distribution in the gas jet is the reason for the particle distribution being nonuniform over the cross section of the jet, such that the overwhelming majority of the solid particles drawn in remain in the peripheral area of the gas jet and relatively few particles are carried in the core area of the gas jet. The energy of the gas jet is correspondingly insufficiently utilized for impact crushing. This is felt to be unsatisfactory not only when impact crushing takes place solely be an exchange of energy between the particles in the gas jet, but also when the latter impact crushing within the gas jet is followed by further impact crushing due to the solid particles suspended and partially crushed in the gas jet being caused to impinge on a stationary impact surface with high energy.

The fact that impact crushing by means of a steam or gas jet introduced into a fluidized bed has been known is documented by, e.g., German Patent No. DE-PS 598 421. The problem of insufficient energy utilization encountered there is dealt with in different ways in German Patent DE 42 43 438 A1 and German Patent Publication No. 20 40 519, on the one hand, and in German Patent DE 33 38 138 C2, on the other hand.

The fluidized-bed counterjet mill known from DE 33 38 138 C2 deals with the improvement of the loading of the gas jets entering a fluidized bed with solid particles taken up from the fluidized bed with the goal of ensuring that the gas jet entering the fluidized bed takes up more solid particles from the fluidized bed. To achieve this, a plurality of additional jet nozzles are arranged in this prior-art fluidized-bed counterjet mill concentrically around a nozzle opening into the milling chamber or the bed of material such that the longitudinal axes of the gas jets from the central main nozzle and the additional jet nozzles arranged concentrically with it intersect at a point on the longitudinal axis of the jet of the main nozzle. The purpose of this solution is to swirl up the bed of material in the area of discharge of the main nozzle and thus to improve the taking up of solid particles from the fluidized bed by the gas jet discharged from the main nozzle by the gas jet from the main nozzle taking up more solid particles from the swirled-up bed of material than would be possible in the case of a nonswirled bed of material.

To improve utilization of the energy of the jet, the solutions according to the other two patent publications DE 42 43 438 A1 and DE-OS 20 40 519 provide measures for making uniform the distribution of the solid particles drawn up from the fluidized bed into the steam or gas jet over the cross section of the jet, i.e., measures which cause solid particles to be additionally transported into the core of the jet from the peripheral area of the jet. (A gas jet is referred to in connection with the present invention and the state of the art for reasons of simplification. It is to be appreciated that what is referred to herein as a jet may be either a gas jet or a steam jet).

The necessary movement of the particles at right angles to the direction of the jet is brought about by mechanical means in DE-OS 20 40 519, which leads to an expensive design without optimal result. It is suggested in the case of DE 42 43 438 A1 that the value of the jet impulse be caused to change at least twice between a minimum and a maximum at the time of discharge from the jet nozzle in the circumferential area of the nozzle cross section and that the value of the jet impulse in the core area be maintained at most at a value that corresponds to the minimum of the circumferential area. Flow channels, in which there is a pressure gradient from the edge of the jet to the core of the jet, so that solid particles are drawn from the edge of the jet into the core of the jet, are created in this solution in the jet areas with low jet impulse immediately at right angles to the direction of the jet after the discharge of the jet from the jet nozzle. This is brought about with a device that is characterized by a nozzle element that can be inserted into a holder for generating the jet, which nozzle element is provided with at least two discharge openings of different shape and size distributed uniformly over the cross section of the nozzle element. Problems can be expected in the case of this solution if greatly different operating conditions must be taken into account.

Consequently, while the above-mentioned solutions seek to improve the loading of the gas jet entering the fluidized bed with solid particles, either by increasing the number of solid particles taken up from the fluidized bed according to DE 33 38 138 C2, or by making the distribution of the solid particles uniform over the cross section of the jet according to DE 42 43 438 A1 and DE-OS 20 40 519, something completely different is sought to be achieved in another prior-art fluidized-bed jet mill according to WO 90/04457. The exchange of energy between a plurality of gas jets loaded with solid particles is increased when these gas jets impact on each other. The distribution of the solid particles within each of the gas jets or the loading of the gas jet with solid particles is completely irrelevant in this solution.

SUMMARY OF THE INVENTION

The present invention pertains to the problem of making uniform the distribution of the solid particles in a gas jet which enters a fluidized bed such that it takes up solid particles from the fluidized bed when entering same. Thus, the present invention is based especially on the state of art according to DE 42 43 438 A1 and DE-OS 20 40 519, and it is to cause solid particles taken up by the gas jet from the fluidized bed to also reach the core area of the gas jet.

Consequently, the object of the present invention is to design a device such that the particle distribution in a gas jet introduced with high energy into a fluidized bed of a fluidized-bed jet mill over the cross section of the jet and especially the loading of this gas jet with solid particles from the fluidized bed are improved over what was previously possible even in the core area of the jet with simple and reliably operating means.

DESCRIPTION OF THE DRAWINGS

The present invention will be explained below on the basis of the drawings in which.

DESCRIPTION OF THE PREFERRED EMBODIMENT

Figure 2:
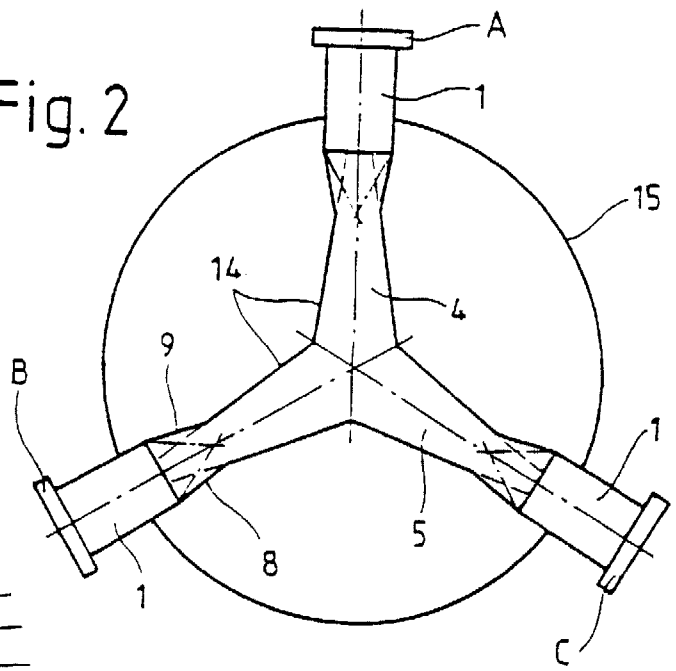
FIG. 2 shows a cylindrical fluidized bed housing with three units according to the present invention according to FIG. 1, which are associated with the housing in a circumferentially symmetrical manner, i.e., they are spaced at equally spaced locations in the circumferential direction of the housing.

A main nozzle 2, in which a gas jet fed in through the supply means 3 is greatly accelerated (Laval nozzle) before it leaves the main nozzle 2, is arranged in a nozzle housing 1. The common longitudinal axis of the rotationally symmetrical nozzle 2 and of the consequently rotationally symmetrical discharged jet 4 is designated by 5. Two auxiliary nozzles 6, 7, provided according to the present invention, are associated with the main nozzle 2 offset by 180° in relation to the another, in such a way that the angles between the longitudinal axis 5 of the main nozzle 2 and of the gas or steam jet 4 discharged from the main nozzle 2 and each of the longitudinal axes 8, 9 of the auxiliary nozzles 6, 7 or of the auxiliary jets 10, 11 discharged from them, which consist of the same gas or steam as the main gas jet discharged from the main jet 2, are in the range of 5° to 60° and preferably in the range of 25° to 45°. The three gas jets enter the bed of material 13 through a common chamber 12 in the front side of the nozzle housing 1, which front side is open in the direction of the jet. Solid particles are drawn by the vacuum in the main gas jet into the main gas jet 4 from the fluidized bed 13 especially in the immediate area around the nozzle 2, and they are brought to the velocity of the main gas jet therein. An exchange of energy takes place over the course of the gas jet between the solid particles drawn in, which breaks them down into smaller particles. Without the auxiliary nozzles, the majority of the particles would be located mainly in the peripheral area of the (main) gas jet, and the crushing of the particles would be limited mainly to this area. To uniformly distribute the particles drawn in from the fluidized bed 13 over the cross section of the gas jet, the auxiliary gas jets penetrate from the auxiliary jets into the main gas flow and "push" part of the particles drawn in into the core area of the main gas jet.

Figure 1:
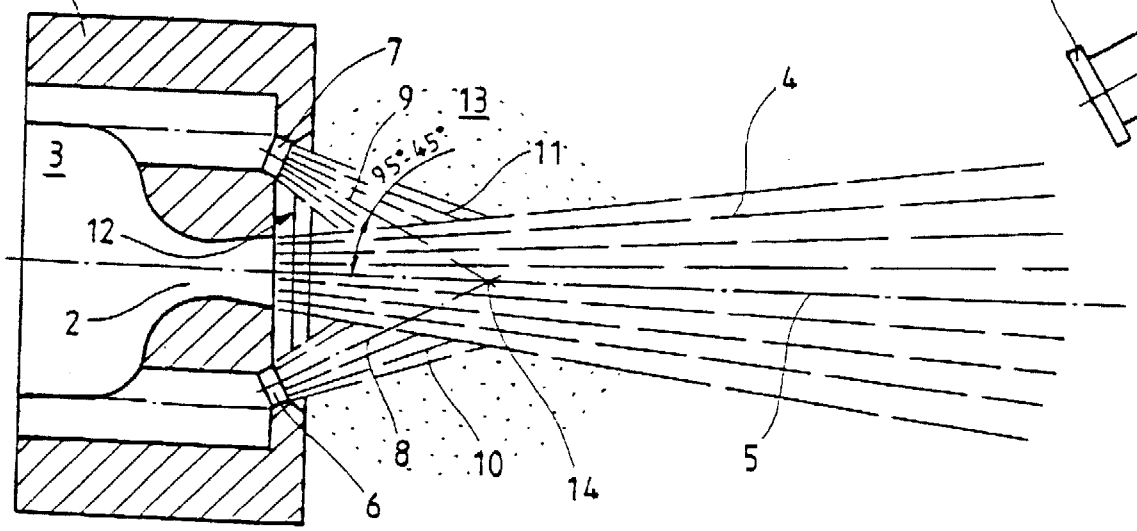
FIG. 1 shows a central longitudinal section through a unit with one main nozzle and two auxiliary nozzles according to the present invention.

According to FIG. 2, three nozzle units A, B, C are provided. Each of these nozzle units is a nozzle unit according to FIG. 1. Three main jets 5 are formed, at least two, and optimally three auxiliary jets corresponding to the two auxiliary jets 10, 11 are associated with each of these main jets, and the three milling jets thus formed from one main jet each and auxiliary jets associated with it meet in a uniting area and around the center 14 of the cylindrical housing 15. Breakdown of solid particles takes place upon the three milling jets meeting each other, but also already in each of the three milling jets, so that the entire device with the three units A, B, C and the housing 15 is designed such that the three milling jets meet each other with high energy and penetrate into each other, and the particles are distributed extensively uniformly in all three gas jets over their cross sections. The housing 15 is a relatively short cylindrical drum.

It is to be appreciated that the foregoing is a description of a preferred embodiment of the invention to which variations and modifications may be made without departing from the spirit and scope of the invention.

What is claimed is:

1. A fluidized-bed jet mill comprising base means, a fluidized bed disposed on said base means, said fluidized bed comprising a fluid in which there are suspended a plurality of solid particles, a nozzle housing mounted on said base means, said nozzle housing having an exit chamber and comprising a main nozzle and a plurality of auxiliary nozzles each of which has a respective discharge end at said nozzle housing exit chamber, each auxiliary nozzle being directed for discharging a jet of gas which intersects a jet of gas from the main nozzle downstream and outside of the nozzle housing for concentrating the particles toward the center of the jet within the fluidized bed thereby enabling particles from the fluidized bed to be drawn into the gas.

2. A device in accordance with claim 1, wherein the auxiliary nozzles are mounted on said base means at uniformly spaced locations concentric with the main nozzle, each of said main nozzle and said auxiliary nozzle having a discharge opening in a common plane, and the direction of each of said auxiliary nozzles intersects the direction of the main nozzle at an angle in the range of 5° to 60°.

3. A device in accordance with claim 2, wherein the range of the angles of intersection is 25° to 45°.

4. A device in accordance with claim 1, wherein three of said auxiliary nozzles surround said main nozzle.

5. A fluidized bed jet mill comprising base means, a fluidized bed disposed on said base means, said fluidized bed comprising a fluid in which there are suspended a plurality of solid particles, and a plurality of respective nozzle assemblies mounted on said base means, each respective nozzle assembly having an exit chamber and comprising a main nozzle and a plurality of auxiliary nozzles each of which has a respective discharge end at said nozzle housing exit chamber, each auxiliary nozzle being directed for discharging a jet of gas which intersects a jet of the discharged gas from said main nozzle downstream and outside of the nozzle housing for concentrating the particles toward the center of the jet within the fluidized bed thereby enabling particles from the fluidized bed to be drawn into the gas said nozzle assemblies being symmetrically mounted on said base.

6. Apparatus in accordance with claim 5 wherein each one of said respective nozzle assemblies further comprises respective control means for controlling the flow of fluid therefrom independently of the others of said respective nozzle assemblies.

* * * * *